US009330813B2

(12) United States Patent
Adachi et al.

(10) Patent No.: US 9,330,813 B2
(45) Date of Patent: May 3, 2016

(54) CONDUCTIVE PATH STRUCTURE AND WIRE HARNESS

(75) Inventors: Hideomi Adachi, Kosai (JP); Hidehiko Kuboshima, Kosai (JP)

(73) Assignee: YAZAKI CORPORATION, Tokyo (JP)

( * ) Notice: Subject to any disclaimer, the term of this patent is extended or adjusted under 35 U.S.C. 154(b) by 125 days.

(21) Appl. No.: 13/819,029

(22) PCT Filed: Sep. 6, 2011

(86) PCT No.: PCT/JP2011/070680

§ 371 (c)(1),
(2), (4) Date: Feb. 26, 2013

(87) PCT Pub. No.: WO2012/033217

PCT Pub. Date: Mar. 15, 2012

(65) Prior Publication Data

US 2013/0153291 A1 Jun. 20, 2013

(30) Foreign Application Priority Data

Sep. 6, 2010 (JP) ..... 2010-198799

(51) Int. Cl.
*H01B 7/00* (2006.01)
*H01R 13/504* (2006.01)
(Continued)

(52) U.S. Cl.
CPC ..... *H01B 7/009* (2013.01); *H01R 13/504* (2013.01); *H01R 13/53* (2013.01); *H01R 31/06* (2013.01)

(58) Field of Classification Search
CPC ..... H01B 7/009; H01R 13/504; H01R 13/53; H01R 31/06
USPC ..... 174/70 R, 70 B, 68.1, 68.2, 68.3, 74 R, 174/72 B, 88 B
See application file for complete search history.

(56) References Cited

U.S. PATENT DOCUMENTS 3,654,590 A 4/1972 Brown
4,353,611 A * 10/1982 Siebens ..... H01F 27/04 439/475

(Continued)

FOREIGN PATENT DOCUMENTS

CN 101080780 A 11/2007
EP 0036243 A1 9/1981

(Continued)

OTHER PUBLICATIONS

Office Action, dated Apr. 15, 2014, issued by the European Patent Office in counterpart European Application No. 11 768 179.1.

(Continued)

*Primary Examiner* — Timothy Thompson
*Assistant Examiner* — Paul McGee, III
(74) *Attorney, Agent, or Firm* — Sughrue Mion, PLLC

(57) ABSTRACT

A conductive path structure includes a conductor that includes a first conductive portion and a second conductive portion which are connected to each other through a cut-off facilitating portion, a first covering member that covers the first conductive portion and the cut-off facilitating portion, and a second covering member that covers the second conductive portion and the cut-off facilitating portion. The second covering member covers the cut-off facilitating portion through the first covering member. The second covering member slidably covers the first covering member.

13 Claims, 7 Drawing Sheets

(51) Int. Cl.
*H01R 13/53* (2006.01)
*H01R 31/06* (2006.01)

(56) References Cited

U.S. PATENT DOCUMENTS

| | | | | |
|---|---|---|---|---|
| 5,213,517 | A | 5/1993 | Kerek et al. | |
| 7,102,256 | B2 * | 9/2006 | Murakami | H02G 5/005 174/117 F |
| 7,332,677 | B2 * | 2/2008 | Xu | H01B 3/427 174/110 R |
| 2005/0011687 | A1 | 1/2005 | Yamaguchi et al. | |
| 2008/0045058 | A1 | 2/2008 | Stepniak et al. | |
| 2010/0181850 | A1 * | 7/2010 | Ichise | F04B 39/0044 310/71 |

FOREIGN PATENT DOCUMENTS

| | | | |
|---|---|---|---|
| EP | 0655805 | A1 | 5/1995 |
| JP | 2004-224156 | A | 8/2004 |
| JP | 2009-37851 | A | 2/2009 |
| JP | 2009-130963 | A | 6/2009 |
| WO | 2006/065540 | A1 | 6/2006 |

OTHER PUBLICATIONS

International Search Report for PCT/JP2011/070680, dated Nov. 30, 2011 [PCT/ISA/210].

Written Opinion for PCT/JP2011/070680, dated Nov. 30, 2011 [PCT/ISA/237].

Office Action, Issued by the State Intellectual Property Office of P.R. China, Dated Aug. 21, 2014, in counterpart Chinese Application No. 201180042980.6.

Communication dated Aug. 26, 2014 issued by the Japanese Patent Office in counterpart Japanese Patent Application No. 2010-198799.

Office Action, Issued by the Japan Patent Office, Dated Nov. 7, 2014, in counterpart Japanese Application No. 2010-198799.

* cited by examiner

CONDUCTIVE PATH STRUCTURE AND WIRE HARNESS

TECHNICAL FIELD

The present invention relates to a structure of a conductive path that includes a conductor and a covering member covering the conductor. Furthermore, the present invention relates to a wire harness that includes a plurality of conductive paths.

BACKGROUND ART

Recently, hybrid motor vehicles and electric motor vehicles as eco cars have been attracting interest. Furthermore, a distribution rate thereof has increased. Hybrid motor vehicles and electric motor vehicles are equipped with a motor as a power source. In order to drive the motor, there is a need to electrically connect a portion between the battery and the inverter, and a portion between the inverter and the motor by a high voltage wire harness. The high voltage wire harness includes a plurality of high voltage wires that is conductive paths.

A plurality of high voltage wire harnesses is suggested. As an example thereof, there is a wire harness disclosed in Patent Literature 1 described below.

CITATION LIST

Patent Literature

[PTL 1] JP-A-2004-224156

SUMMARY OF INVENTION

Technical Problem

When an impact is applied to the hybrid motor vehicle or the electric motor vehicle from the outside, that is, when a collision or the like occurs, the high voltage wire constituting the wire harness may be cut off. When considering a case where the high voltage wire is cut off, whereby the peeled-out conductor comes into contact with a member having conductivity, device, vehicle body frame or the like, it is evident that great electric current flows into the above conductive member, device vehicle body frame or the like, which is very dangerous.

Solution to Problem

The present invention was made in view of the above circumstances, and an object thereof is to provide a conductive path structure and a wire harness capable of ensuring stability even when the conductive path is cut off.

In order to achieve the above object, according to the present invention, there is provided a conductive path structure comprising:

a conductor that includes a first conductive portion and a second conductive portion which are connected to each other through a cut-off facilitating portion;

a first covering member that covers the first conductive portion and the cut-off facilitating portion; and a second covering member that covers the second conductive portion and the cut-off facilitating portion, wherein the second covering member covers the cut-off facilitating portion through the first covering member; and wherein the second covering member slidably covers the first covering member.

According to the present invention having such configuration, when the conductive path is cut off, a first end portion of the first covering member is present at the outside of one conductor end portion cut and separated in the position of the cut-off facilitating portion, whereby the contact to other member is restricted. Furthermore, a second end portion of the second covering member is also present at the outside of the other conductor end portion cut and separated, whereby the contact to other member is also restricted. According to the present invention, even when the conductive path is cut off, the conductor end portion is not exposed.

In addition, according to the present invention, by providing the cut-off facilitating portion in the conductor, it is possible to control a cuttable position of the conductive path.

Preferably, the second covering member covers the cut-off facilitating portion through a gap, and the first covering member is arranged so as to be inserted into the gap.

Preferably, the first covering member directly covers the cut-off facilitating portion.

Preferably, the cut-off facilitating portion is a conductive portion of the conductor on which a groove is formed.

Preferably, the cut-off facilitating portion is a conductive portion of the conductor on which a notch is formed.

Preferably, the cut-off facilitating portion is a conductive portion of the conductor in which a through hole is formed.

Preferably, the cut-off facilitating portion is a conductive portion of the conductor having a thin portion thinner than the first and second conductive portions.

Preferably, a material of the first covering member is different from a material of the second covering member.

Also, the first covering member may be provided by an over-mold process, and the second covering member may be provided by an over-mold process different from that of the first covering member.

According to the above configuration, when the conductor is cut off in the position of the cut-off facilitating portion, at the same time, the first end portion of the first covering member and the second end portion of the second covering member are separated from each other. According to the present invention, since the over-molds are different from each other, an unintended separation is not generated in which one of the first end portion and the second end portion is attached to the other thereof, and thus the conductor is not exposed.

In the present invention, the different over-molds refer to over-molds in which the timings of the molding are different from each other, the molding materials are different from each other or the like.

Furthermore, there is provided a wire harness including a plurality of conductive paths each having the conductive path structure described above.

According to the above configuration, since the wire harness includes the plurality of conductive paths of the structure in which the conductor end portion is not exposed, even when the conductive path is cut off, the stability is ensured.

Advantageous Effects of Invention

According to the present invention described above, an effect is exhibited in which the exposure of the conductive end portions of the conductor can be prevented even when the conductor is cut off. Thus, an effect is exhibited in which the stability can be ensured.

According to the present invention described above, an effect is exhibited in which the first end portion of the first covering member and the second end portion of the second covering member can be reliably separated from each other. Thus, an effect is exhibited in which the exposure of the conductive end portion can be more reliably prevented.

According to the present invention described above, an effect is exhibited in which the wire harness having high stability can be provided.

DESCRIPTION OF EMBODIMENTS

A conductive path structure of the present invention is a structure of a conductive path that restricts contact of a conductor to other member by a first end portion of a first covering member to be existed at the outside of one conductor end portion of the conductor which is cut and divided at a position of the cut-off facilitating portion. Furthermore, the conductive path structure is a structure of the conductive path that restricts contact of the conductor to other member by a second end portion of a second covering member to also be existed at the outside of the other conductor end portion which is cut and separated. A wire harness of the present invention includes a plurality of conductive paths of such a structure.

EXAMPLE

Figure 1:
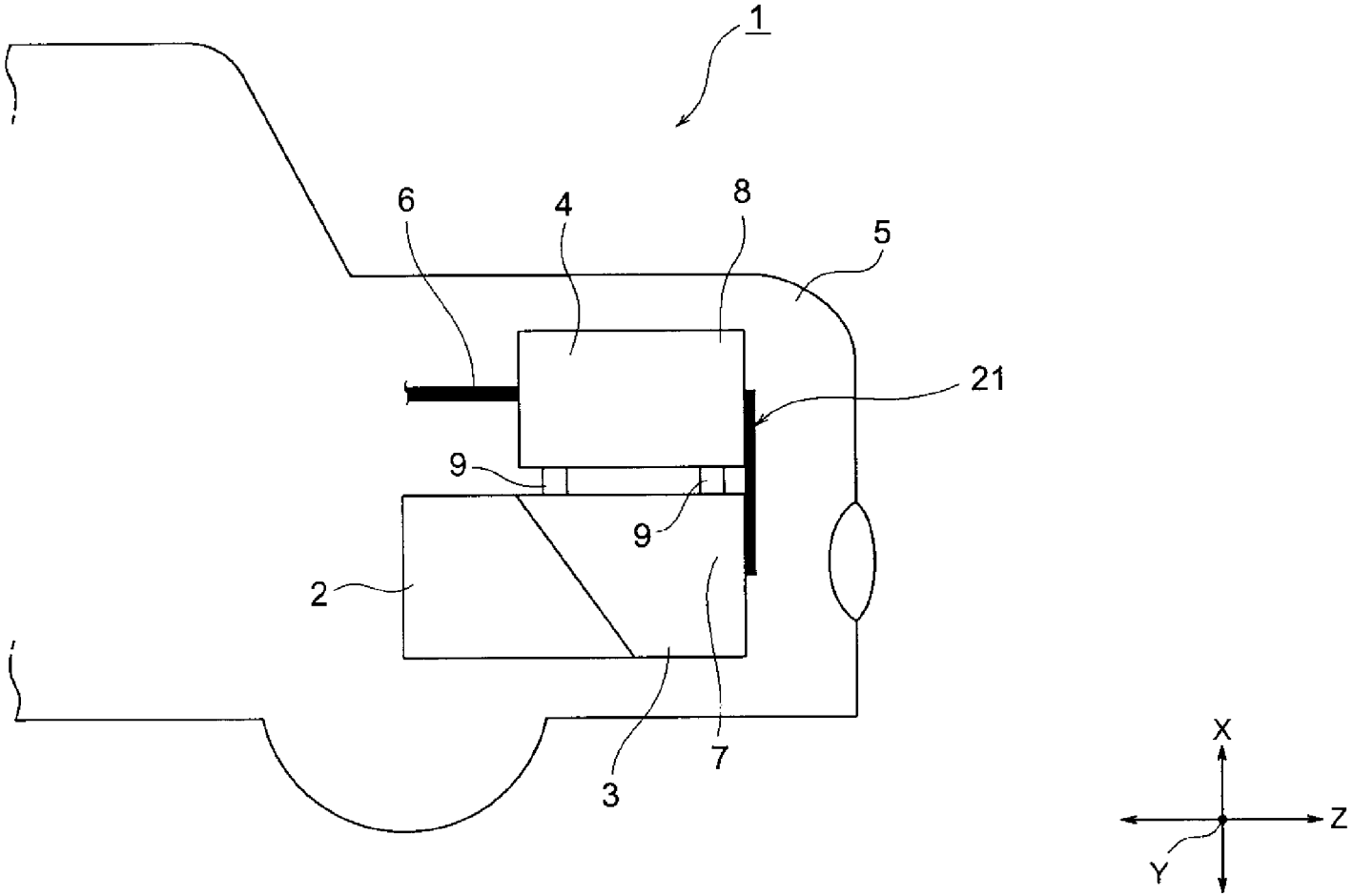
FIG. 1 is a schematic diagram that shows an arrangement example of a wire harness of the present invention.
Figure 2:
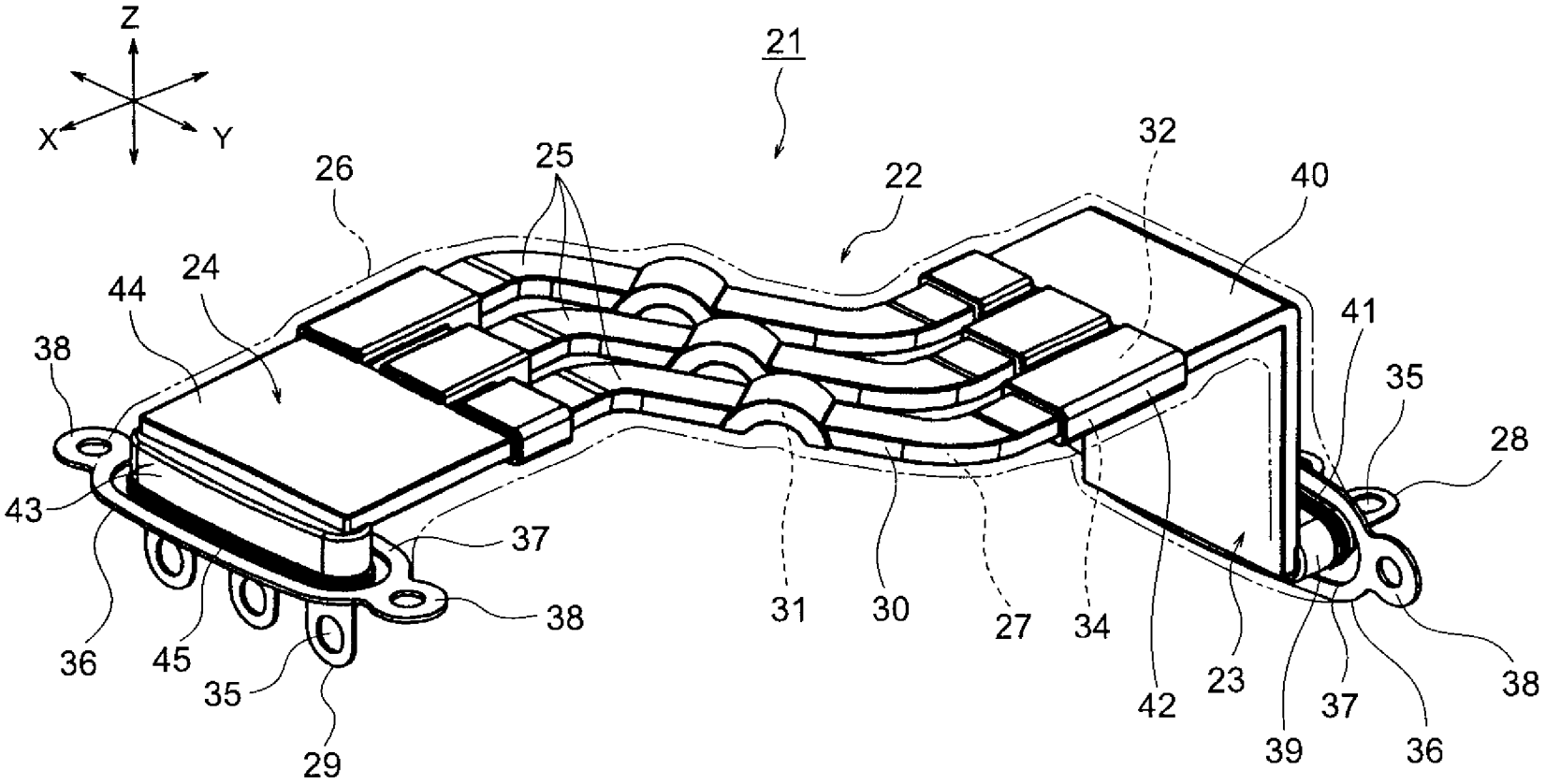
FIG. 2 is a perspective view of the wire harness.
Figure 3:
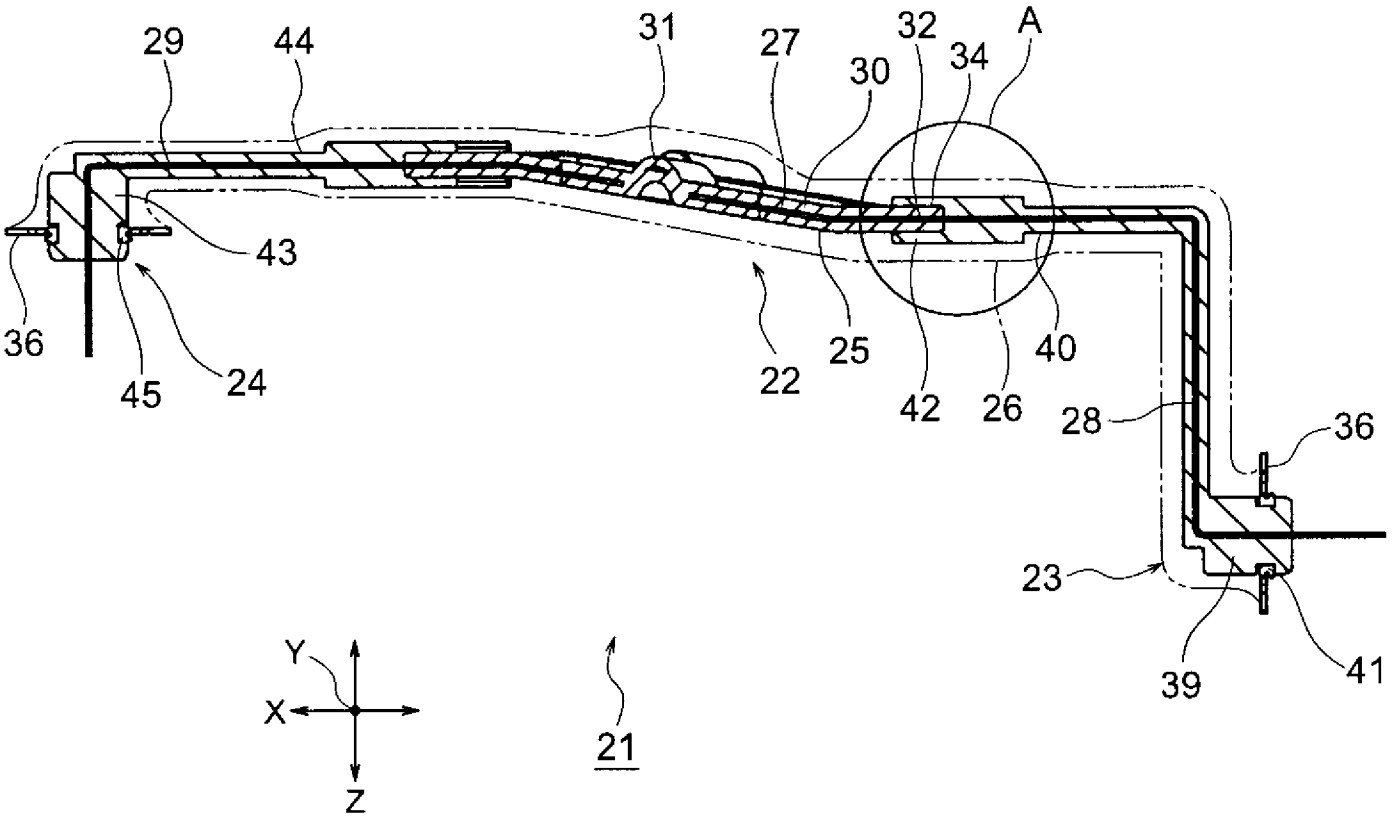
FIG. 3 is a cross-sectional view of the wire harness.
Figure 4:
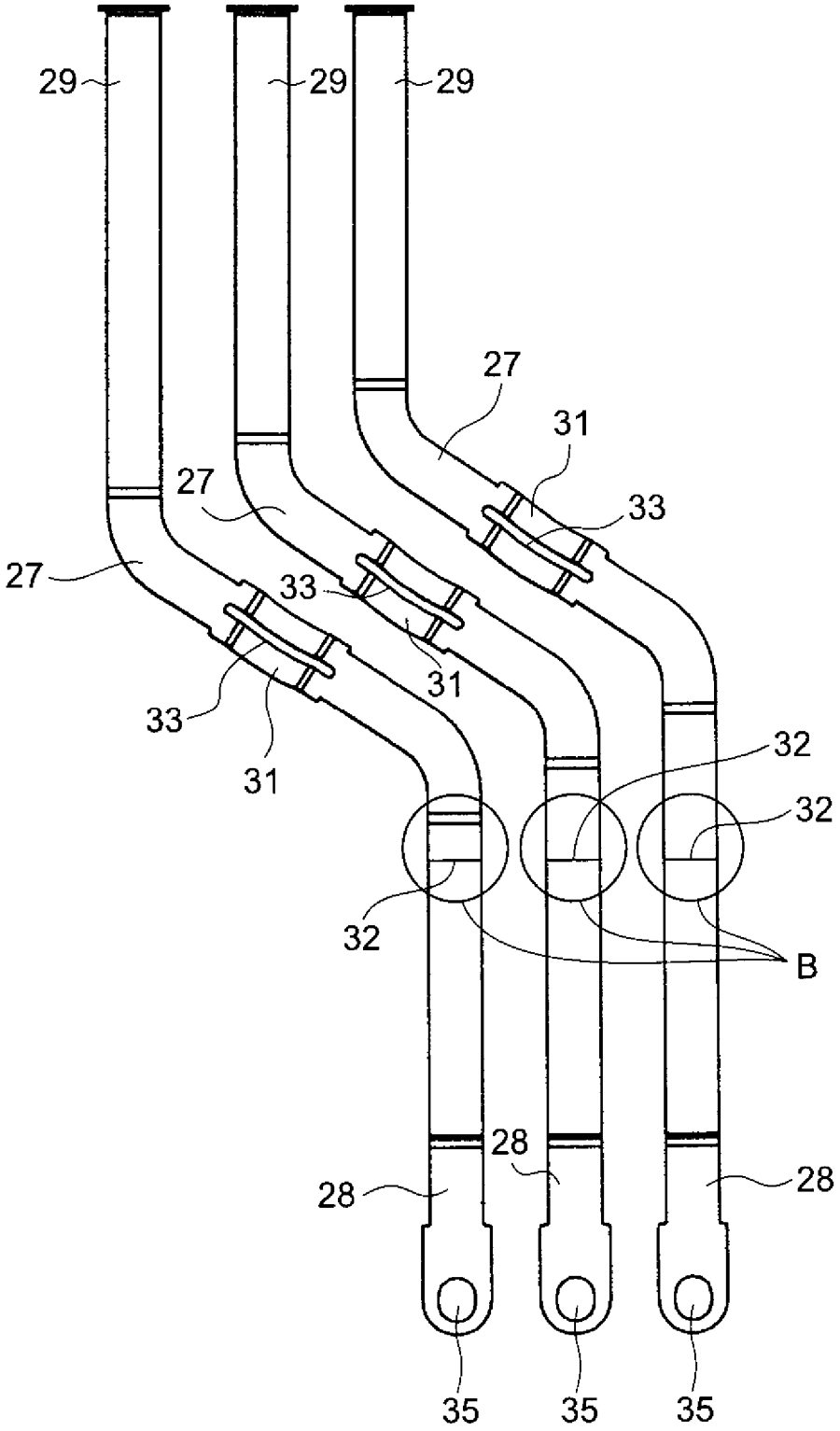
FIG. 4 is a bottom view of a conductor.
Figure 5A:
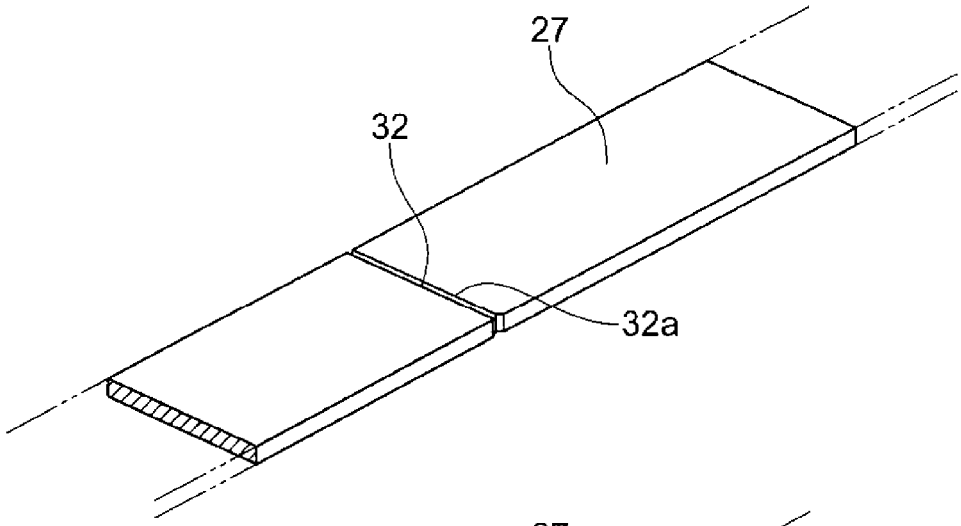
FIG. 5A is an enlarged perspective view of circle portion B of FIG. 4, and FIGS. 5B and 5C are enlarged perspective views of modified examples.
Figure 5B:
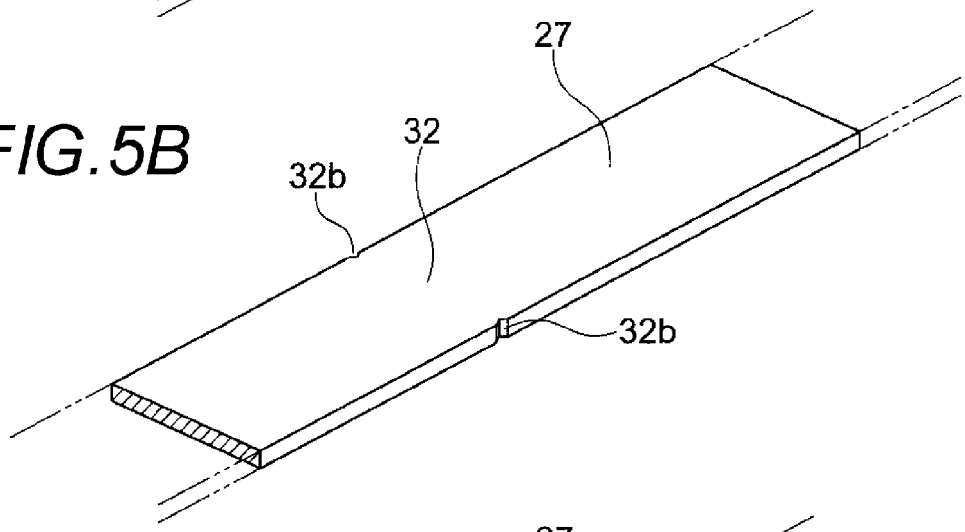
Figure 5C:
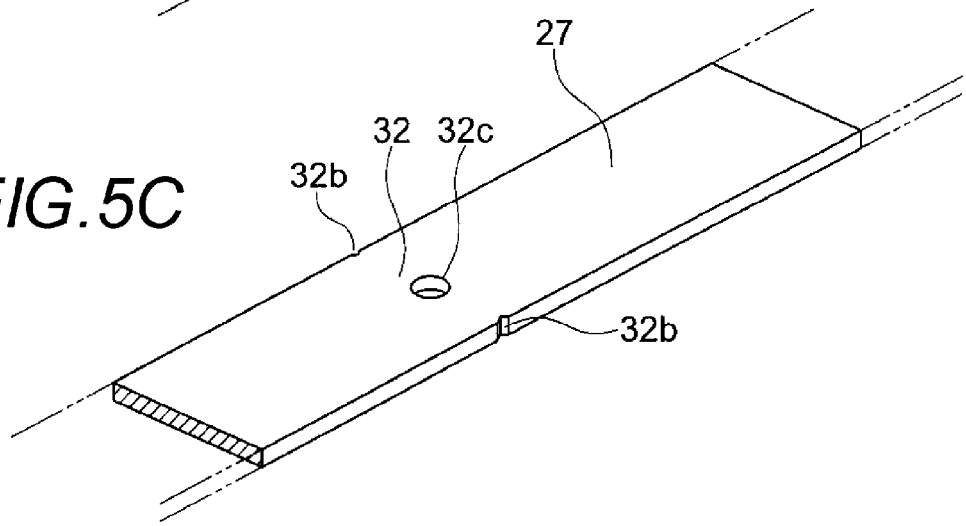
Figure 6:
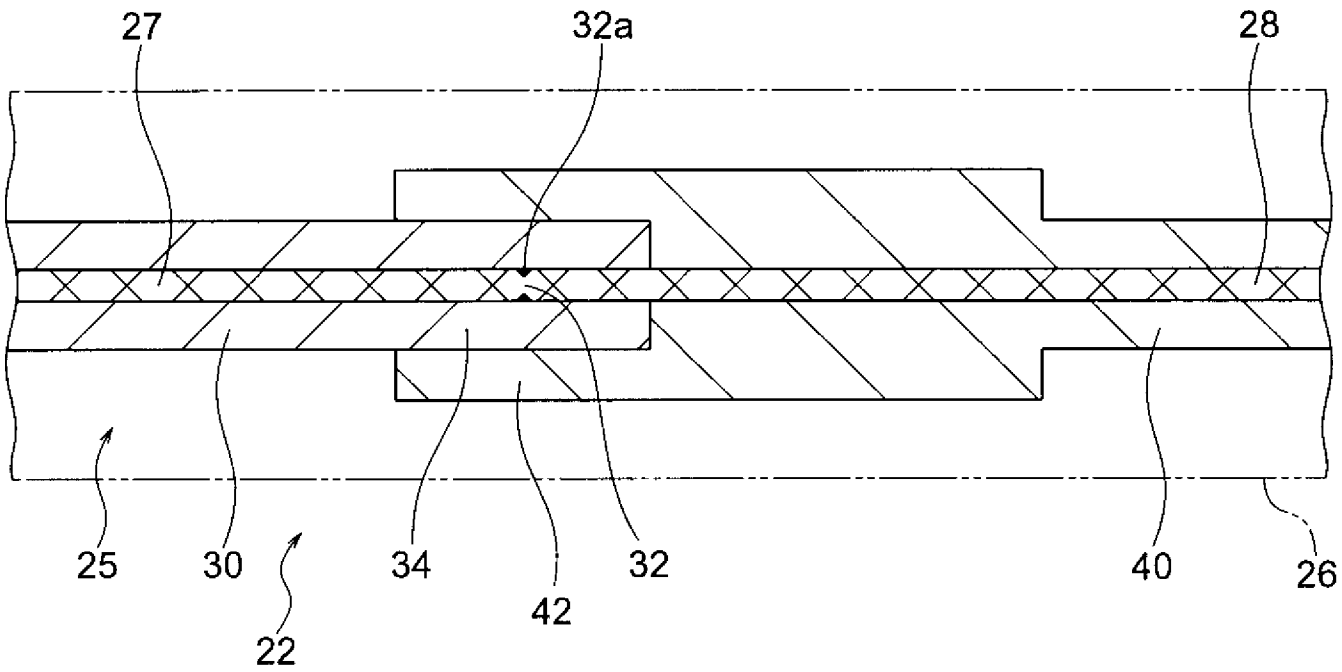
FIG. 6 is an enlarged cross-sectional view of a circle portion A of FIG. 3 that shows a conductive path structure of the present invention.
Figure 7:
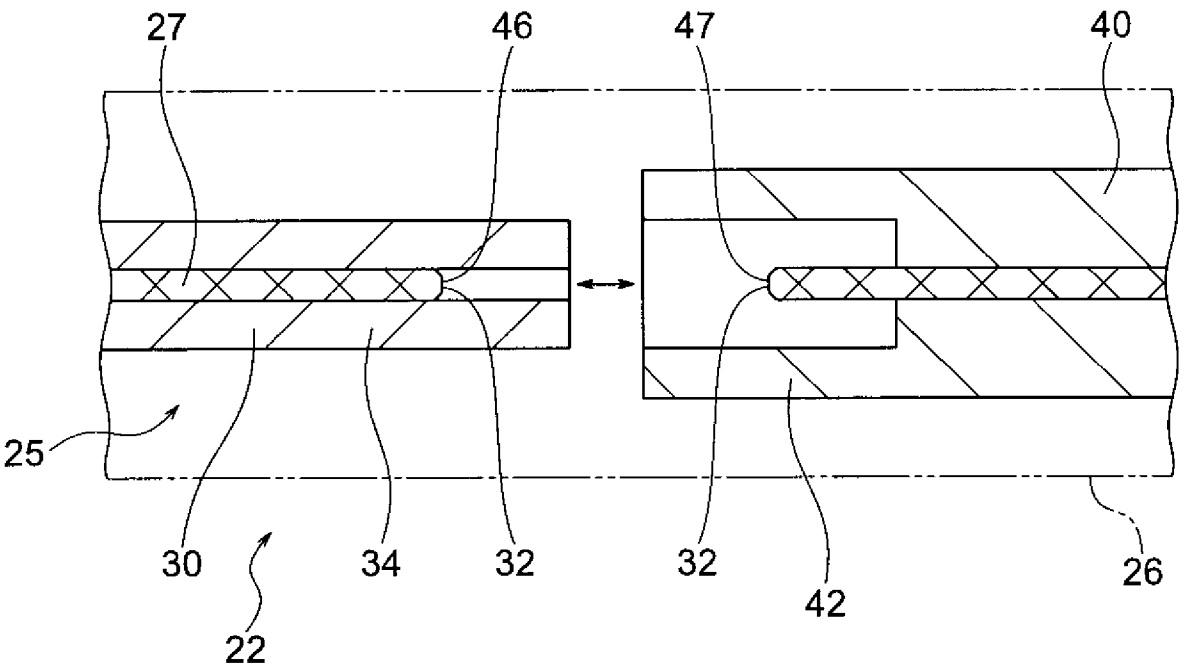
FIG. 7 is an enlarged cross-sectional view that shows a cut-off state.

Hereinafter, an embodiment will be described with reference to the drawings. FIG. 1 is a schematic diagram that shows an accessory example of the wire harness of the present invention. Furthermore, FIG. 2 is a perspective view of the wire harness, FIG. 3 is a cross-sectional view of the wire harness, FIG. 4 is a bottom view of the conductor, FIGS. 5A to 5C are enlarged perspective views of a circle portion B of FIG. 4, FIG. 6 is an enlarged cross-sectional view of a circle portion A of FIG. 3 that shows a conductive path structure of the present invention, and FIG. 7 is an enlarged cross-sectional view that shows a cut-off state.

The wire harness of this embodiment is aimed at being placed in a hybrid motor vehicle or an electric motor vehicle. Hereinafter, the hybrid motor vehicle will be described as an example (even in the case of the electric motor vehicle, the configuration, the structure and the effect of the wire harness of the present invention are basically identical. Furthermore, the present invention can be applied to a normal motor vehicle or the like without being limited to a hybrid motor vehicle or an electric motor vehicle).

In FIG. 1, reference numeral 1 indicates a hybrid motor vehicle. The hybrid motor vehicle 1 is a vehicle that mixes powers from an engine 2 and a motor unit 3 to drive. Electric power from a battery (a battery pack) (not shown) is supplied to the motor unit 3 via an inverter unit 4. The engine 2, the motor unit 3, and the inverter unit 4 are installed (mounted) in an engine room 5 of a position where a front wheel or the like is present in this embodiment. Furthermore, the battery (not shown) is installed (mounted) in a motor vehicle interior present in the rear part of the engine room 5 or a motor vehicle rear portion in which a rear wheel or the like is present.

The motor unit 3 and the inverter unit 4 are connected to each other by a wire harness 21 adapted to high voltage. Furthermore, the battery (not shown) and the inverter unit 4 are connected to each other by a high voltage wire harness 6. The wire harness 6 is arranged from the engine room 5 to the bottom floor, which is a ground side of a floor panel.

Herein, a supplementary description will be made on this embodiment. The motor unit 3 includes a motor and a generator. Furthermore, the inverter unit 4 includes an inverter and a converter. The motor unit 3 is formed as a motor assembly including a shield case 7. Furthermore, the inverter unit 4 is also formed as an inverter assembly including a shield case 8. The battery (not shown) is a Ni-MH-based battery or a Li-ion-based battery and is formed in a module shape. Furthermore, for example, it is also possible to use an electricity storage device such as a capacitor. The battery (not shown) is not particularly limited as long as it can be used in the hybrid motor vehicle 1 or the electric motor vehicle.

The inverter unit 4 is placed and fixed immediately over the motor unit 3 in this embodiment. That is, the inverter unit 4 and the motor unit 3 are placed so as to come into close contact with each other. Due to such an installation state, the wire harness 21 is shortened. Concerning the inverter unit 4 and the motor unit 3, reference numeral 9 indicates a fixing leg portion for being placed and fixed immediately over the motor unit 3.

In the drawings, an arrow X indicates a vertical direction of the vehicle. Furthermore, an arrow Y indicates a left and right direction of the vehicle (a width direction of the vehicle). Additionally, an arrow Z indicates a front and back direction of the vehicle.

Firstly, a configuration and a structure relating to the wire harness 21 of this embodiment will be specifically described.

In FIGS. 2 and 3, the wire harness 21 includes a harness main body 22, a motor side connector 23 provided in one end of the harness main body 22, and an inverter side connector 24 provided in the other end of the harness main body 22. The motor side connector 23 and the inverter side connector 24 include a part of the harness main body 22.

The harness main body 22 includes a plurality (herein, three) of high voltage conductive paths 25 (conductive paths) aligned on approximately the same plane at predetermined intervals, and an electromagnetic shield member 26 that collectively covers the plurality of high voltage conductive paths 25.

The high voltage conductive paths 25 have a conductor main body 27, and connection portions 28 and 29 that are continuously provided at one end and the other end of the conductor main body 27. In this embodiment, the conductor main body 27 and the connection portions 28 and 29 correspond to the conductor (if the connection portion is a terminal fitting, the conductor main body corresponds to the conductor). Furthermore, the high voltage conductive paths 25 have a first over-mold portion 30 (first covering member) provided outside the conductor main body 27, besides the conductor main body 27 and the connection portions 28 and 29.

The connection portion 28 connected to one end of the conductor main body 27 is provided as a portion that constitutes a part of the motor side connector 23. Furthermore, similarly, the connection portion 29 connected to the other end of the conductor main body 27 is also provided as a portion that constitutes a portion of the inverter side connector 24.

In FIG. 4, the conductor main body 27 and the connection portions 28 and 29 are conductors constituting the conductive path as mentioned above, and are formed by pressing a metal plate (that is made of copper, copper alloy or aluminum) having conductivity in this embodiment. The conductor main body 27 and the connection portions 28 and 29 are formed in a bus bar (a band plate shape) shape having a predetermined conductor width and thickness.

Furthermore, the conductor is not limited to the bus bar shape. For example, a conductor (a rod shape) formed by twisting the strand, or a conductor (for example, a conductor formed of a straight angle single core or a circular single core) having a section of a rectangular shape or a round shape may be adopted. The conductor is not particularly limited if it can be provided in a cut-off facilitating portion 32 described later, that is if a cuttable portion is provided.

The conductor main body 27 is formed in a curved shape of an approximately crank shape when viewed from a plane in this embodiment (it may be straight). In the middle of such a conductor main body 27, a tolerance absorption portion 31 is provided. Furthermore, in a predetermined position becoming the connection portion 28 side of the conductor main body 27, the cut-off facilitating portion 32 is provided.

The tolerance absorption portion 31 is formed so that it can hold a predetermined displacement or a shape. The tolerance absorption portion 31 is formed so as to have a mountain shape (a valley shape) in this embodiment (the shape is an example). As a more specific shape, the tolerance absorption portion 31 is formed in a semicircular shape. The tolerance absorption portion 31 is formed so that it can promote a decline in rigidity of the conductor main body 27, in other words, it can facilitate bending or stretching (so that it can facilitate displacement, and so that it can facilitate mobility).

In addition, the tolerance absorption portion 31 is formed so that it can maintain the state after the bending or the stretching thereof. That is, the tolerance absorption portion 31 is formed so that it does not return to the state before the bending or the stretching (slight returning is not a problem and the tolerance absorption portion 31 may return so that the operability or the connection reliability is not affected).

In the tolerance absorption portion 31, a slit 33 is formed. The slit 33 is formed in the middle of the conductor width direction in the tolerance absorption portion 31. Furthermore, the slit 33 is formed so as to be extended in a direction approximately intersecting the conductor width direction. The slit 33 is formed as a portion that further promotes a decline in rigidity in the tolerance absorption portion 31. Since a reduction in cross-sectional area is not generated due to the formation of the slit 33 in the tolerance absorption portion 31, the tolerance absorption portion 31 is formed so as to slightly bulge outside in the conductor width direction.

Furthermore, one tolerance absorption portion 31 is provided in the conductor main body 27 in this embodiment, but the provision is not limited thereto. Furthermore, the tolerance absorption portion 31 is provided in an approximately center position of the conductor main body 27, the provision is not limited thereto. That is, the tolerance absorption portion 31 may be provided in the number and the place necessary for a predetermined displacement or the like.

In FIGS. 4, and 5A to 5C, the cut-off facilitating portion 32 is provided as a cuttable portion in the conductor main body 27. Furthermore, for example, when external force such as a collision is applied to a vehicle, the cut-off facilitating portion 32 is provided as a portion that is cut off right ahead in the conductor main body 27.

The cut-off facilitating portion 32 is configured that a groove 32*a* is formed over the whole periphery of a bus bar as shown in FIG. 5A, that a V shaped groove or a U shaped groove is formed in a plane portion of a bus bar although it is not shown, that the notch 32*b* is formed in both side portions of the bus bar as shown in FIG. 5B, that both of the hole 32*c* penetrating a plane portion of the bus bar and the notch 32*b* as shown in FIG. 5C, or that the bus bar plane portion is pressed so as to be a thinly form, although it is not particularly shown, or the like.

Furthermore, the cut-off facilitating portion 32 is placed in a predetermined position becoming the connection portion 28 side of the conductor main body 27 as mentioned above, but the placement is not limited thereto.

In regard to the cut-off facilitating portion, a case is considered where the cut-off facilitating portion 32 mentioned above is not provided. As an example of this case, it is provided the tolerance absorption portion 31 having the slit 33 to function as the cut-off facilitating portion.

In FIGS. 2, 3, and 6, the first over-mold portion 30 is provided as a covering member having the insulation property and flexibility. The first over-mold portion 30 can protect the conductor main body 27, and can perform waterproofing or the like. The first over-mold portion 30 is formed by over-molding the conductor main body 27 by the use of elastomer such as rubber or thermoplastic elastomer.

In this embodiment, a covering range (reference numerals omitted) shown by the first over-mold portion 30 corresponds to the first covering target portion.

The first over-mold portion 30 has a first terminal portion 34 as one end portion (this portion is located at the connection portion 28 side). The first terminal portion 34 covers the cut-off facilitating portion 32. Furthermore, the first terminal portion 34 does not expose one conductor end portion 46 described later.

In FIGS. 2 to 4, the connection portions 28 and 29 are formed so as to match the form of a connection portion (not shown) in the motor unit 3 and the inverter unit 4 (see FIG. 1). Furthermore, the connection portions 28 and 29 are formed so as to match the forms of the motor side connector 23 and the inverter side connector 24. In this embodiment, connection portions (not shown) of the connection portion 28 and the motor unit 3 can overlap with each other and be fastened with a bolt and a nut, and connection portions (not shown) of the connection portion 29 and the inverter unit 4 can overlap with each other and be fastened with a bolt and a nut. In the respective tip positions of the connection portions 28 and 29, through holes 35 are formed.

In FIGS. 2 to 7, the electromagnetic shield member 26 is a member for exhibiting an electromagnetic shield function, and is configured by, for example, forming a braid or a metal foil in a cylinder shape. The electromagnetic shield member 26 is formed to have a length that covers the motor side connector 23 and the inverter side connector 24 in this embodiment.

The electromagnetic shield member 26 is generally fixed by the use of a shield shell. However, in this embodiment, the electromagnetic shield member 26 is fixed by the use of the fastening fixing member 36 having the conductivity, and a bolt (not shown) that can fasten the fastening fixing member 36 to the shield case 7 of the motor unit 3 and the shield case 8 (see FIG. 1) of the inverter unit 4. The fastening fixing member 36 has a terminal pressing portion 37 formed in an annulus plate shape, and a pair of fixing portions 38 connected to the terminal pressing portion 37. In the pair of fixing portions 38, bolt insertion holes (the reference numerals are omitted) relative to the bolt (not shown) are formed therethrough.

The electromagnetic shield member 26 forms a relief portion relative to a pair of fixing portions 38 in the terminal portion. When inserting the terminal pressing portion 37 with the terminal portion faced the outside thereon, and turning over the terminal portion to the inside after the insertion to pass through the inner edge of the terminal pressing portion 37, a holding portion of an approximately bag shape is hereby formed to enable the fastening fixing member 36 to be held. Moreover, when fixing the fastening fixing member 36 by a bolt (not shown), the terminal portion of the electromagnetic shield member 26 is interposed between the terminal pressing portion 37 and the shield case 7 (8), whereby the electrical connection is also completed.

In FIGS. 2 and 3, the motor side connector 23 includes the connection portion 28 in the high voltage conductive path 25. Furthermore, the motor side connector 23 includes a housing portion 39 that is provided by over-molding the connection portion 28, and a second over-mold portion 40 (a second covering member). The tip of the motor side connector 23 is inserted into the shield case 7 (see FIG. 1) of the motor unit 3, and the inner portion thereof is electrically connected.

The housing portion 39 is formed in a shape that can exhibit the function as a connector housing. In a tip outer edge of the housing portion 39, a rubber packing 41 is provided. In the rear end of the housing portion 39, the second over-mold portion 40 is continuously formed. The housing portion 39 and the second over-mold portion 40 are formed concurrently by the over-mold.

In FIGS. 3 and 6, the second over-mold portion 40 is provided as a covering member having the insulation property. The second over-mold portion 40 can protect the connection portion 28, and can perform the waterproofing or the like. The end portion of the second over-mold portion 40 is formed as a second terminal portion 42.

The second terminal portion 42 covers the first terminal portion 34 in a separatable manner. Furthermore, the second terminal portion 42 covers the cut-off facilitating portion 32 in the state of interposing the first terminal portion 34. Moreover, the second terminal portion 42 does not expose the other conductor end portion 47 described later.

In this embodiment, a covering range (reference numerals omitted) shown by the second over-mold portion 40 corresponds to the second covering target portion.

In FIGS. 2 and 3, similar to the motor side connector 23, the inverter side connector 24 includes the connection portion 29 in the high voltage conductive path 25. Furthermore, the inverter side connector 24 includes a housing portion 43 that is provided by over-molding the connection portion 29, and a third over-mold portion 44. The tip of the inverter side connector 24 is inserted into the shield case 8 (see FIG. 1) of the inverter unit 4, and the inner portion thereof is electrically connected.

The housing portion 43 is formed in a shape that has a function as a connector housing. In a tip outer edge of the housing portion 43, a rubber packing 45 is provided. In the rear end of the housing portion 43, the third over-mold portion 44 is continuously formed. The third over-mold portion 44 is formed similarly to the second over-mold portion 40.

Next, the arrangement of the wire harness 21 will be described based on the configuration and the structure mentioned above.

In FIGS. 1 to 3, in the arrangement of the wire harness 21, an operation is firstly performed in which the motor side connector 23 is connected and fixed to the motor unit 3, and the terminal portion (a terminal portion of one end side) of the electromagnetic shield member 26 via the fastening fixing member 36 and a bolt (not shown) is connected and fixed to the shield case 7. When the connection and fixing are completed by the operation, one end of the wire harness 21 enters a fixed state.

When one end of the wire harness 21 is fixed, next, an operation is performed in which the inverter side connector 24 is connected and fixed to the inverter unit 4. Furthermore, an operation is performed in which the terminal portion (a terminal portion of the other end side) of the electromagnetic shield member 26 via the fastening fixing member 36 and a bolt (not shown) is connected and fixed to the shield case 8. At this time, for example, when a position deviation is generated in the inverter unit 4, or when a size tolerance is relatively increased, the position of the inverter side connector 24 is displaced to absorb the position deviation or the size tolerance, and then the connection fixing is completed (since the wire harness 21 has the tolerance absorption portion 31, the displacement can be absorbed by the bending or the stretching to arrow X, Y, and Z directions by the tolerance absorption portion 31, whereby the position deviation or the size tolerance can be absorbed).

Next, an operation of the wire harness 21, when a collision occurs in the hybrid motor vehicle 1, will be described.

In FIG. 1, when a case where a collision occurs in the hybrid motor vehicle 1, the inverter unit 4 is, for example, moved rearward with respect to the engine 2 and the motor unit 3. Since the wire harness 21 is connected to the motor unit 3 and the inverter unit 4, when the inverter unit 4 is moved rearward, the impact, which pulls the wire harness 21, is applied to the wire harness 21.

When the impact is applied to the wire harness 21, the force is applied to the conductor main body 27 of the high voltage conductive path 25 constituting the wire harness 21, whereby, as shown in FIGS. 6 and 7, the conductor main body 27 is cut off at the position of the cut-off facilitating portion 32. At this time, the conductor main body 27 is divided into the one conductor end portion 46 and the other conductor end portion 47. When the conductor main body 27 is cut and divided at the position of the cut-off facilitating portion 32, the first terminal portion 34 of the first over-mold portion 30 and the second terminal portion 42 of the second over-mold portion 40 are separated from each other.

On the outside of the one conductor end portion 46, the first terminal portion 34 of the first over-mold portion 30 is provided, whereby the electrical connection is restricted from the one conductor end portion 46. Furthermore, on the outside of the other conductor end portion 47, the second terminal portion 42 of the second over-mold portion 40 is also provided, whereby the electrical connection is restricted from the other conductor end portion 47.

As mentioned with reference to FIGS. 1 to 7, according to the present invention, the exposure of one conductor end portion 46 and the other conductor end portion 47 can be prevented by the first terminal portion 34 and the second terminal portion 42 even when the high voltage conductive path 25 is cut off. Thus, an effect is exhibited in which the stability can be ensured. In addition, according to the present invention, the wire harness 21 having high stability can be provided.

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

The present application is based on Japanese Patent Application No. 2010-198799 filed on Sep. 6, 2010, the contents of which are incorporated herein by reference.

INDUSTRIAL APPLICABILITY

A conductive path structure and a wire harness capable of ensuring stability even when the conductive path is cut off can be provided.

REFERENCE SIGNS LIST

1 hybrid motor vehicle
2 engine
3 motor unit
4 inverter unit
5 engine room
6 wire harness
21 wire harness
22 harness main body
23 motor side connector
24 inverter side connector
25 high voltage conductive path (conductive path)
26 electromagnetic shield member
27 conductor main body (conductor)
28, 29 connection portion (conductor)
30 first over-mold portion (first covering member)
31 tolerance absorption portion
32 cut-off facilitating portion
33 slit
34 first terminal portion
35 through hole
36 fastening fixing member
37 terminal pressing portion
38 fixing portion
39 housing portion
40 second over-mold portion (second covering portion)
41 rubber packing
42 second terminal portion
43 housing portion
44 third over-mold portion
45 rubber packing
46 one conductor end portion
47 other conductor end portion

The invention claimed is:

1. A conductive path structure comprising: a conductor that includes a first conductive portion and a second conductive portion which are connected to each other through a cut-off facilitating portion, the first conductive portion, the second conductive portion, and the cut-off facilitating portion forming a single conductive member, wherein a cross-sectional area of the cut-off facilitating member is smaller than a cross-sectional area of the first conductive portion and the second conductive portion; a first covering member that covers the first conductive portion and the cut-off facilitating portion; and a second covering member that covers the second conductive portion and the cut-off facilitating portion, wherein the second covering member covers the cut-off facilitating portion through the first covering member; wherein the second covering member slidably covers the first covering member; and wherein the cut-off facilitating portion is configured to separate the first conductive portion and the second conductive portion when a sufficient force is applied to the conductive path structure.

2. The conductive path structure according to claim 1, wherein the second covering member covers the cut-off facilitating portion through a gap; and wherein the first covering member is arranged so as to be inserted into the gap.

3. The conductive path structure according to claim 1, wherein the first covering member directly covers the cut-off facilitating portion.

4. The conductive path structure according to claim 1, wherein a material of the first covering member is different from a material of the second covering member.

5. The conductive path structure according to claim 1, wherein the cut-off facilitating portion is a conductive portion of the conductor on which a groove is formed.

6. The conductive path structure according to claim 1, wherein the cut-off facilitating portion is a conductive portion of the conductor on which a notch is formed.

7. The conductive path structure according to claim 1, wherein the cut-off facilitating portion is a conductive portion of the conductor in which a through hole is formed.

8. The conductive path structure according to claim 1, wherein the cut-off facilitating portion is a conductive portion of the conductor having a thin portion thinner than the first and second conductive portions.

9. A wire harness including a plurality of conductive paths each having the conductive path structure according to claim 1.

10. The conductive path structure according to claim 1, wherein the conductor is formed such that the first conductive portion and the second conductive portion are connected as a single conductor.

11. The conductive path structure according to claim 1, wherein the single conductive member is a flat metal plate.

12. A conductive path structure comprising:

a conductor that includes a first conductive portion and a second conductive portion which are connected to each other through a cut-off facilitating means for separating the first conductive portion from the second conductive portion when a sufficient force is applied to the conductive path structure;

a first covering member that covers the first conductive portion and the cut-off facilitating means; and a second covering member that covers the second conductive portion and the cut-off facilitating means, wherein the second covering member covers the cut-off facilitating means through the first covering member;

wherein the second covering member slidably covers the first covering member.

13. A conductive path structure comprising:

a conductor that includes a first conductive portion and a second conductive portion which are connected to each other through a cut-off facilitating portion;

a first covering member that covers the first conductive portion and the cut-off facilitating portion;

a second covering member that covers the second conductive portion and the cut-off facilitating portion; and a tolerance absorption portion formed on the first conductive portion having a slit extending in a direction approximately intersecting the conductor width direction, wherein the second covering member covers the cut-off facilitating portion through the first covering member;

wherein the second covering member slidably covers the first covering member; and wherein the cut-off facilitating portion is configured to separate the first conductive portion and the second conductive portion when a sufficient force is applied to the conductive path structure.

* * * * *